US011358271B2

(12) United States Patent
Chang

(10) Patent No.: US 11,358,271 B2
(45) Date of Patent: Jun. 14, 2022

(54) SOCKET STORAGE DEVICE

(71) Applicant: CHUN NIEN PLASTIC LTD., Taichung (TW)

(72) Inventor: Chi-Tsai Chang, Taichung (TW)

(73) Assignee: CHUN NIEN PLASTIC LTD., Taichung (TW)

( * ) Notice: Subject to any disclaimer, the term of this patent is extended or adjusted under 35 U.S.C. 154(b) by 0 days.

(21) Appl. No.: 17/032,633

(22) Filed: Sep. 25, 2020

(65) Prior Publication Data

US 2022/0097223 A1 Mar. 31, 2022

(51) Int. Cl.
*B25H 3/00* (2006.01)

(52) U.S. Cl.
CPC ..... *B25H 3/003* (2013.01)

(58) Field of Classification Search
CPC ..... B25H 3/003; B25H 3/021; B25H 3/06; B25H 3/04; B25H 3/00; B25H 3/02; B25H 3/006; B25H 3/025; B25B 13/56; E05B 73/0023; E05B 69/006; E05B 69/00; E05B 73/00; E05B 73/02; B65D 5/4204; A47F 1/128; A47F 5/0861; A47F 5/0838; A47F 5/0846; A47F 5/0853; A47F 5/0093; A47F 3/085; A47F 7/0028; A47F 7/24; A47B 46/005; A47B 81/065; A47B 61/02; A47B 46/00; A47B 53/00; A47B 53/02; A47B 95/008; A47B 96/067; A47B 61/06; A47B 88/42; Y10T 292/1043; B42F 15/0094; A47G 25/746
See application file for complete search history.

(56) References Cited

U.S. PATENT DOCUMENTS 4,461,500 A * 7/1984 van der Horst ..... E05B 65/0835 292/106
5,337,987 A * 8/1994 Sawatsky ..... A47B 96/067 24/543
7,264,213 B2 * 9/2007 Liu ..... A47F 5/0006 206/378

(Continued)

FOREIGN PATENT DOCUMENTS

CA 2755941 A1 * 3/2013 ..... B25H 3/04
DE 3142675 A1 * 5/1983 ..... E05D 1/04

(Continued)

*Primary Examiner* — J. Gregory Pickett
*Assistant Examiner* — Abigail Elizabeth Guidry
(74) *Attorney, Agent, or Firm* — Muncy, Geissler, Olds & Lowe, P.C.

(57) ABSTRACT

A socket storage device is provided, including: a base and a socket holder. The base has an assembling portion. The socket holder is disposed on the assembling portion and rotatable between a first position and a second position. The socket holder includes an insertion portion and a locking portion. The insertion portion includes an engagement portion. The locking portion includes a blocking portion being movable between a third position and a fourth position. When the socket holder is in the first position, the blocking portion is in the third position, the locking portion is biased against the engagement portion, and the engagement portion is unmovable relative to the insertion portion; when the socket holder is in the second position, the blocking portion is in the fourth position, and the engagement portion is movable relative to the insertion portion.

11 Claims, 7 Drawing Sheets

(56) References Cited

U.S. PATENT DOCUMENTS 7,438,495 B2 * 10/2008 Chou ..... B25G 3/18 403/322.1
9,339,127 B1 * 5/2016 Chen ..... B25H 3/04
9,528,303 B1 * 12/2016 Lai ..... A47F 5/0861
11,091,778 B2 * 8/2021 Winnard ..... A61K 39/215
2004/0188366 A1 * 9/2004 Tong ..... B25H 3/003 211/70.6
2004/0211691 A1 * 10/2004 Winnard ..... B25H 3/003 206/378
2005/0126943 A1 * 6/2005 Liu ..... B65D 73/0064 206/378
2005/0218023 A1 * 10/2005 Winnard ..... B25H 3/003 206/378
2005/0221664 A1 * 10/2005 Winnard ..... B25H 3/003 439/510
2006/0151406 A1 * 7/2006 Hsien-Chung ..... A47F 5/0838 211/70.6
2009/0001111 A1 * 1/2009 Lin ..... B25H 3/003 224/245
2009/0158787 A1 * 6/2009 Lin ..... A47F 5/0861 70/58
2010/0065520 A1 * 3/2010 Hsieh ..... B25H 3/06 211/70.6
2012/0138553 A1 * 6/2012 Kao ..... B25H 3/06 211/70.6
2013/0306581 A1 * 11/2013 Kao ..... A47B 81/00 211/49.1
2014/0209780 A1 * 7/2014 Chang ..... F16M 13/005 248/551
2017/0361453 A1 * 12/2017 Kao ..... B25H 3/04
2019/0091842 A1 * 3/2019 Chou ..... B25H 3/04
2020/0299045 A1 * 9/2020 Hsu ..... B65D 73/0064
2021/0039245 A1 * 2/2021 Kukucka ..... B25H 3/003
2021/0060761 A1 * 3/2021 Chang ..... B25H 3/003

FOREIGN PATENT DOCUMENTS

DE 102007001423 A1 * 7/2008 ..... B25H 3/003
EP 1441093 A2 * 7/2004 ..... E05B 73/0023
EP 1681139 A1 * 7/2006 ..... B25H 3/003
GB 2445152 A * 7/2008 ..... B65D 73/0064
TW M591466 U 3/2020

* cited by examiner

SOCKET STORAGE DEVICE

BACKGROUND OF THE INVENTION

Field of the Invention

The present invention relates to a socket storage device.

Description of the Prior Art

A conventional storage device for hand tools includes a sliding rail and a receiving unit which is slidable on the sliding rail, and the receiving unit is configured to be assembled with a socket. The receiving unit includes a supporting column and an elastic piece which is elastically swingable relative to the supporting column, and the elastic piece has a projection protruding therefrom. The elastic piece provides an elastic force to bias the projection against the socket and restrict the socket. For detaching the socket from the receiving unit, the elastic piece is moved toward the supporting column so as to release the socket from the projection.

However, the elastic piece of the conventional storage device is easy to become fatigued in long-term use, which results in insufficient elastic force and poor restriction effect to the socket and the socket is easy to be departed from the receiving unit.

The present invention is, therefore, arisen to obviate or at least mitigate the above-mentioned disadvantages.

SUMMARY OF THE INVENTION

The main object of the present invention is to provide a socket storage device, including a socket holder which is configured for a socket to lock thereto or release therefrom by rotation of the socket holder and provides good restriction effect.

To achieve the above and other objects, the present invention provides a socket storage device, including: a base and a socket holder. The base has an assembling portion. The socket holder is disposed on the assembling portion and rotatable between a first position and a second position. The socket holder includes an insertion portion and a locking portion. The insertion portion is configured to be detachably connected with a socket. The insertion portion includes an engagement portion which is movable. The locking portion includes a blocking portion which is movable between a third position and a fourth position. When the socket holder is in the first position, the blocking portion is in the third position, the locking portion is biased against the engagement portion, and the engagement portion is unmovable relative to the insertion portion and configured to be abutted tightly against the socket; when the socket holder is in the second position, the blocking portion is in the fourth position, and the engagement portion is movable relative to the insertion portion and the socket is detachable from the insertion portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
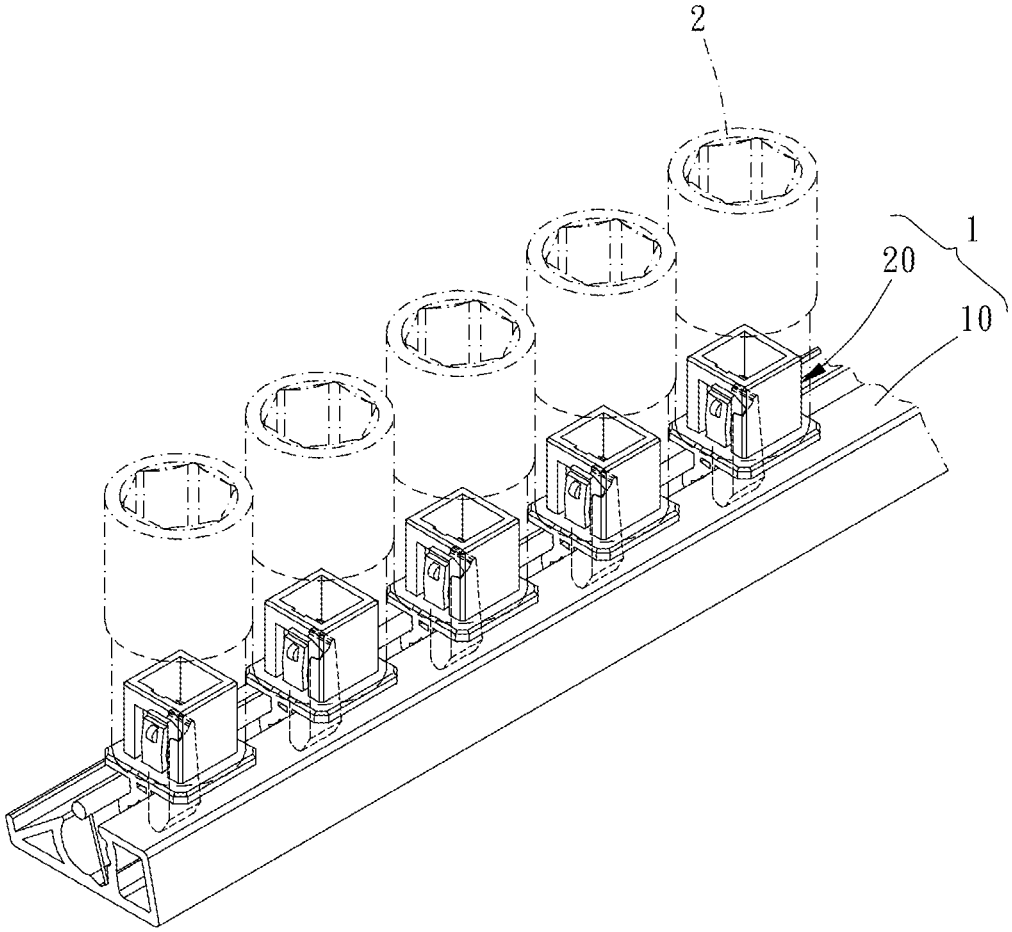
FIG. 1 is a stereogram of a preferable embodiment of the present invention.
Figure 3:
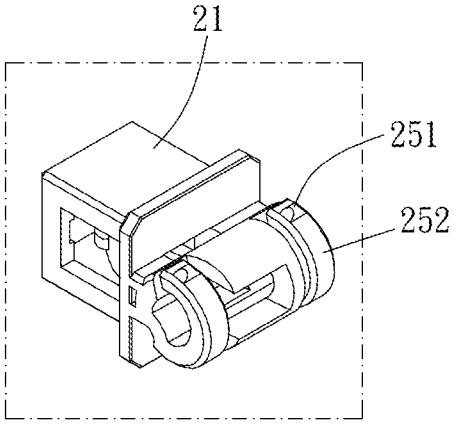
FIG. 3 is a stereogram showing a socket holder according to a preferable embodiment of the present invention.
Figure 2:
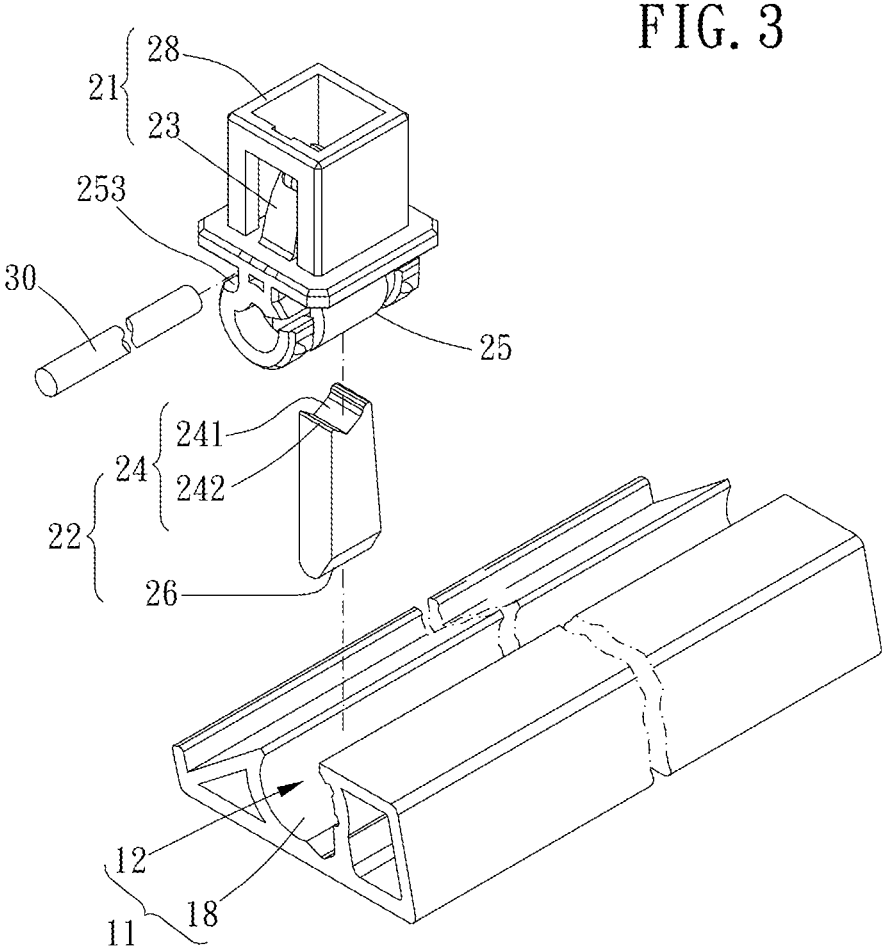
FIG. 2 is a breakdown drawing of a preferable embodiment of the present invention.
Figure 4:
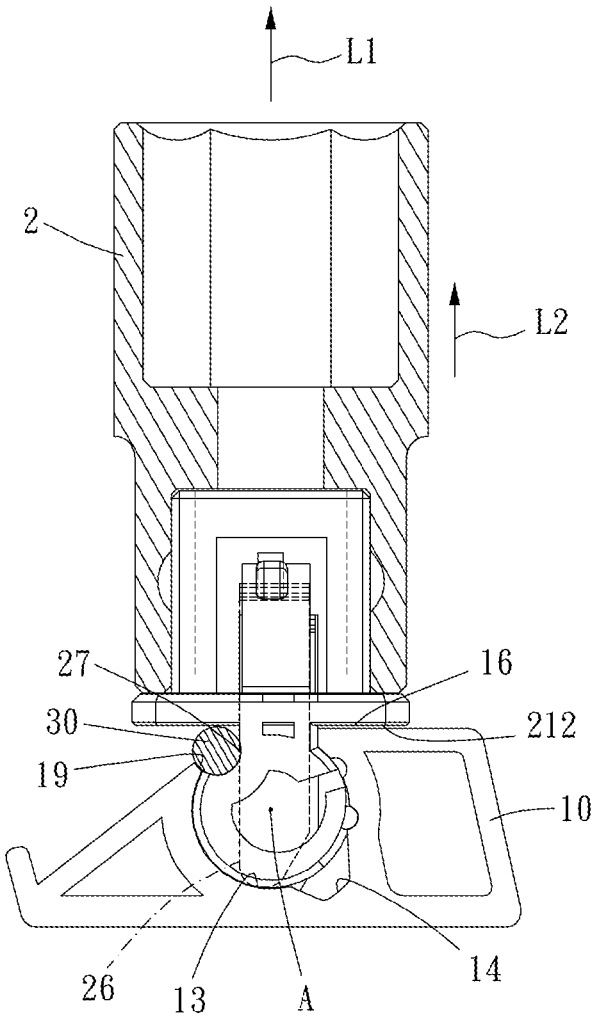
FIG. 4 is a partial cross-sectional view of a preferable embodiment of the present invention.
Figure 5:
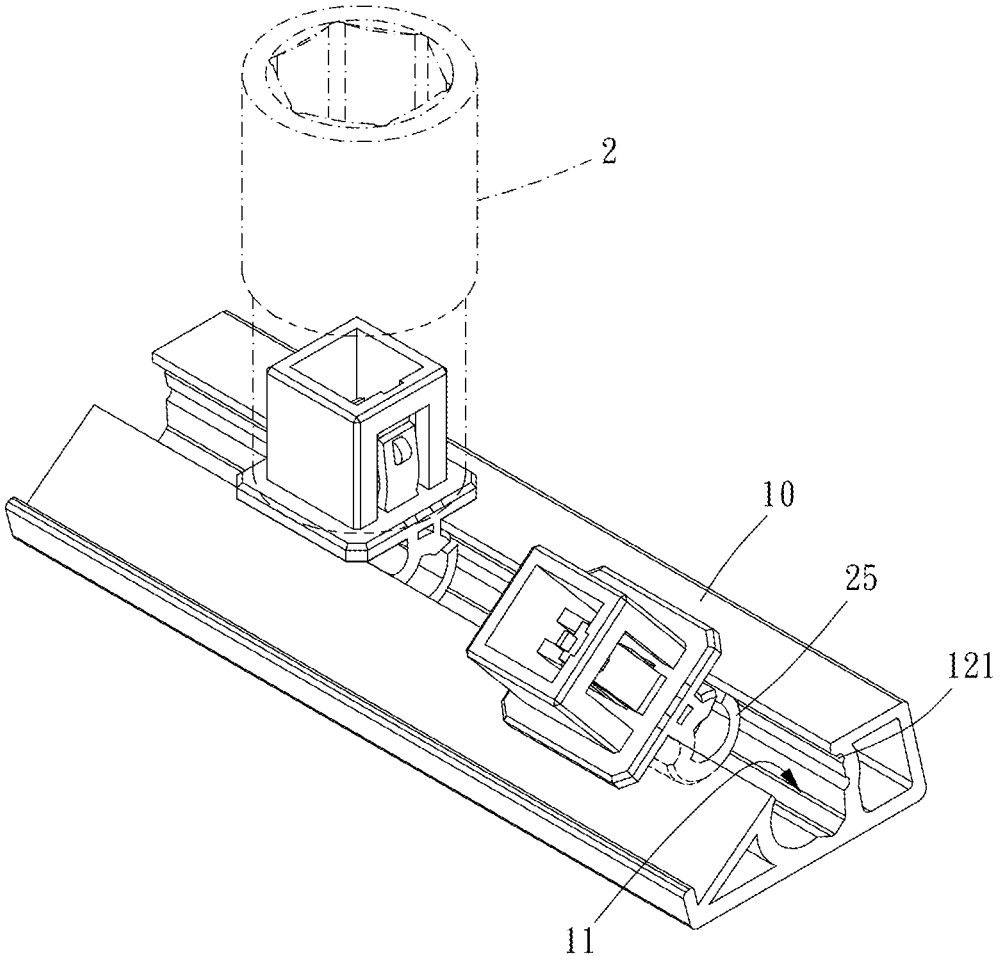
FIG. 5 is a schematic diagram of a preferable embodiment of the present invention in use.
Figure 6:
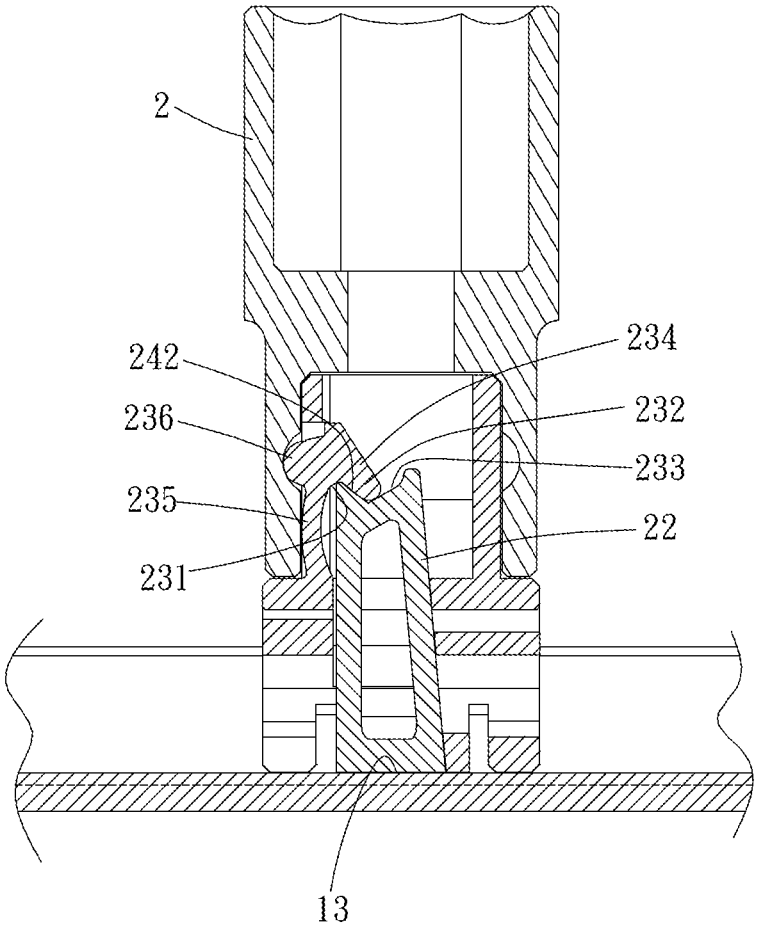
FIG. 6 is a cross-sectional view showing the socket holder in a first position according to a preferable embodiment of the present invention.
Figure 7:
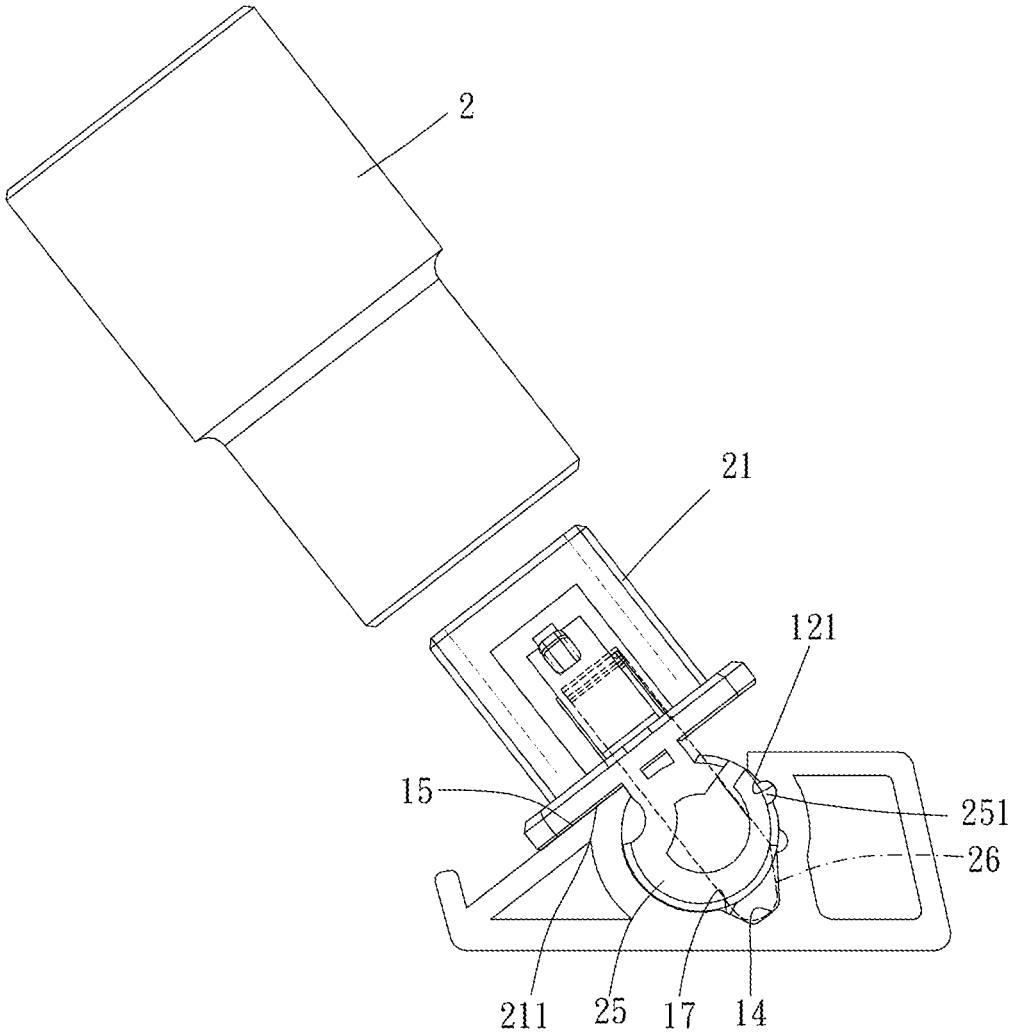
FIG. 7 is a schematic diagram showing the socket holder in a second position according to a preferable embodiment of the present invention.
Figure 8:
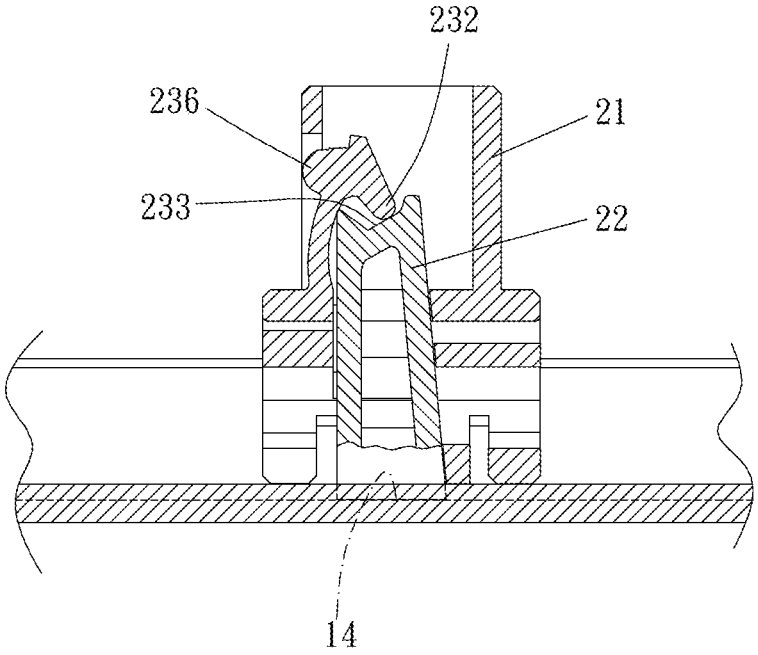
FIG. 8 is a cross-sectional view showing the socket holder in the second position according to a preferable embodiment of the present invention.

Please refer to FIGS. 1 to 8 for a preferable embodiment of the present invention. A socket storage device 1 of the present invention includes a base 10 and a socket holder 20.

The base 10 has an assembling portion 11. The socket holder 20 is disposed on the assembling portion 11 and rotatable between a first position and a second position. The socket holder 20 includes an insertion portion 21 and a locking portion 22. The insertion portion 21 is configured to be detachably connected with a socket 2. The insertion portion 21 includes a main portion 28 and an engagement portion 23 which is movable relative to the main portion 28. The locking portion 22 has a blocking portion 24 which is movable between a third position and a fourth position. When the socket holder 20 is in the first position, the blocking portion 24 is in the third position, the locking portion 22 is biased against the engagement portion 23, and the engagement portion 23 is unmovable relative to the main portion 28 and configured to be abutted tightly against the socket 2; when the socket holder 20 is in the second position, the blocking portion 24 is in the fourth position, and the engagement portion 23 is movable relative to the main portion 28 and the socket 2 is detachable from the insertion portion 21. Therefore, the socket 2 is lockable with the socket holder 20 by rotation of the socket holder 20 relative to the base 10, which provides good locking and positioning effects.

Specifically, the base 10 defines a vertical direction L1 extending vertically from a bottom of the base 10 toward a top of the base 10. The socket holder 20 further includes a connecting portion 25 connected with the assembling portion 11. The connecting portion 25 and the insertion portion 21 are arranged on a first direction L2. The first direction L2 is parallel to the vertical direction L1 when the socket holder 20 is in the first position, and the first direction L2 is lateral to the vertical direction L1 when the socket holder 20 is in the second position. When the socket holder 20 is in the first position, the insertion portion 21 is configured to be stably assembled with the socket 2; when the socket holder 20 is the second position, the insertion portion 21 is configured for the socket 2 to be smoothly attached thereto or detached therefrom.

The assembling portion 11 includes an arcuate slot 12 and an arcuate concave surface 18 defining the arcuate slot 12. The arcuate slot 12 defines a central axis A. The locking portion 22 further includes a leg portion 26. The leg portion 26 is abutted against a first abutting portion 13 of the arcuate concave surface 18 when the blocking portion 24 is in the third position, and the leg portion 26 is abutted against a second abutting portion 14 of the arcuate concave surface 18 when the blocking portion 24 is in the fourth position. A radial interval between the first abutting portion 13 and the central axis A is smaller than a radial interval between the second abutting portion 14 and the central axis A so that the locking portion 22 is movable and positionable relative to the insertion portion 21. In this embodiment, the second abutting portion 14 is a groove. In other embodiments, the first abutting portion and the second abutting portion may be continues stepped surfaces so as to provide height difference.

The base 10 further has a first blocking surface 15 and a second blocking surface 16 which are disposed at two opposite sides of the arcuate slot 12, and an extending direction of the second blocking surface 16 is lateral to an extending direction of the first blocking surface 15. The insertion portion 21 has a first abutting surface 211 which is abuttable against the first blocking surface 15 and a second abutting surface 212 which is abuttable against the second blocking surface 16, which provides appropriate rotation range of the socket holder 20 and good supporting force. In this embodiment, the first blocking surface 15 is an inclined plane so as to stably support the socket holder 20.

Specifically, the arcuate slot 12 defines a circumferential direction around the central axis A. The first abutting portion 13 and the second abutting portion 14 are arranged on the circumferential direction. The arcuate concave surface 18 has an inclined guiding surface 17 disposed between the first abutting portion 13 and the second abutting portion 14, and the inclined guiding surface 17 is close to the central axis A in a direction from the second abutting portion 14 toward the first abutting portion 13 so that the blocking portion 24 is configured to be abutted tightly against the socket 2. Preferably, the first abutting portion 13 is an arcuate surface which is close to the central axis A in a direction toward the second abutting portion 14 so as to prevent the leg portion 26 from being moved unexpectedly to the second abutting portion 14.

The connecting portion 25 is a pivot, and the pivot is rotatably disposed within the arcuate slot 12. The connecting portion 25 has at least one first engaging portion 251, and the arcuate slot 12 has at least one second engaging portion 121. The at least one first engaging portion 251 is detachably engaged with the at least one second engaging portion 121. One of the at least one first engaging portion 251 and the at least one second engaging portion 121 is a recess, and the other of the at least one first engaging portion 251 and the at least one second engaging portion 121 is a projection. Preferably, the connecting portion 25 further has at least one elastic engaging portion 252 which is radially deformable, and the at least one first engaging portion 251 is disposed on the at least one elastic engaging portion 252 so that the connecting portion 25 is radially biased against and positioned on the base 10 and not easy to be swung unexpectedly. In this embodiment, a number of the at least one elastic engaging portion 252 is two, and two said elastic engaging portions 252 are spaced apart from each other so as to have good positioning effect. Moreover, each of the two said elastic engaging portions 252 is C-shaped so as to be elastically deformable. In this embodiment, the connecting portion 25 has a plurality of first engaging portions 251 and a plurality of second engaging portions 121, and one of the plurality of first engaging portions 251 is detachably engaged with one of the plurality of second engaging portions 121. Each of the plurality of first engaging portions 251 is the projection, and each of the plurality of second engaging portions 121 is the recess so that the socket holder 20 is stably positioned on the first position or the second position.

The engagement portion 23 is formed in a hooked shape. The engagement portion 23 has an engaging slot 231. The blocking portion 24 has a concave portion 241 and an apex corner 242. The engagement portion 23 and the blocking portion 24 are engaged with each other. The apex corner 242 is disposed within the engaging slot 231, and a free end 232 of the engagement portion 23 is disposed within the concave portion 241 so as to have good connecting strength of the engagement portion 23 and the blocking portion 24. Preferably, the engaging slot 231 has an inclined abutting surface 233. The inclined abutting surface 233 is inclined away from the leg portion 26 in a direction remote from the engagement portion 23, and the free end 232 of the engagement portion 23 is abutted against the inclined abutting surface 233 so that the engagement portion 23 is configured to be abutted tightly against the socket 2.

The engagement portion 23 is radially swingable relative to the main portion 28. The engagement portion 23 has a head section 234 and a neck section 235. The neck section 235 is bent toward a radial direction of the insertion portion 21. The locking portion 22 is axially movable and abutted against the head section 234, and the head section 234 has a protruding structure 236 protruding radially from the neck section 235 and configured to be abutted against the socket 2, which allows the engagement portion 23 to be elastically swung and return to its original position.

The socket storage device 1 further includes a locking rod 30. The locking rod 30 is connected with the base 10. The connecting portion 25 has a notch 253 radially disposed thereon, and the locking rod 30 is disposed within the notch 253. The base 10 and the socket holder 20 respectively have a first restricting portion 19 and a second restricting portion 27 which are disposed at two opposite sides of the locking rod 30 and abutted against the locking rod 30 so that the socket holder 20 is unswingable relative to the base 10 to achieve anti-theft effect. Furthermore, the locking rod 30 is removable from the base 10 by disconnecting the connection of the locking rod 30 and the base 10 so that the socket holder 20 is swingable.

In operation, when the socket holder 20 is in the first position (when the socket holder 20 is vertical to the base 10), the blocking portion 24 is biased against the engagement portion 23 and the engagement portion 23 is configured to be abutted tightly against the socket 2 so that the socket 2 is not easy to be detached from the insertion portion 21. When the socket holder 20 is in the second position (when the socket holder 20 is inclined to the base 10), the blocking portion 24 is moved toward the bottom of the base 10 to derestrict the engagement portion 23 so that the socket 2 is disengaged from the engagement portion 23 and removable from the insertion portion 21.

In summary, the socket storage device of the invention includes the socket holder which is configured for the socket to lock thereto or release therefrom by rotation of the socket holder, which provides rapid assembling/disassembling and good restriction effects.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A socket storage device, including:

a base, having an assembling portion;

a socket holder, disposed on the assembling portion and being rotatable between a first position and a second position, including an insertion portion and a locking portion, the insertion portion configured to be detachably connected with a socket, the insertion portion including a main portion and an engagement portion which is movable relative to the main portion, the locking portion including a blocking portion which is movable between a third position and a fourth position;

wherein when the socket holder is in the first position, the blocking portion is in the third position, the locking portion is biased against the engagement portion, and the engagement portion is unmovable relative to the main portion and configured to be abutted tightly against the socket; when the socket holder is in the second position, the blocking portion is in the fourth position, and the engagement portion is movable relative to the main portion and the socket is detachable from the insertion portion;

wherein the assembling portion includes an arcuate slot and an arcuate concave surface defining the arcuate slot, the arcuate slot defines a central axis, the locking portion further includes a leg portion, the leg portion is abutted against a first abutting portion of the arcuate concave surface when the blocking portion is in the third position, the leg portion is abutted against a second abutting portion of the arcuate concave surface when the blocking portion is in the fourth position; and a radial interval between the first abutting portion and the central axis is smaller than a radial interval between the second abutting portion and the central axis.

2. The socket storage device of claim 1, wherein the base defines a vertical direction extending vertically from a bottom of the base toward a top of the base, the socket holder further includes a connecting portion connected with the assembling portion, the connecting portion and the insertion portion are arranged on a first direction, the first direction is parallel to the vertical direction when the socket holder is in the first position, and the first direction is lateral to the vertical direction when the socket holder is in the second position.

3. The socket storage device of claim 1, wherein the second abutting portion is a groove.

4. The socket storage device of claim 1, wherein the arcuate slot defines a circumferential direction around the central axis, the first abutting portion and the second abutting portion are arranged on the circumferential direction; the arcuate concave surface has an inclined guiding surface disposed between the first abutting portion and the second abutting portion, and the inclined guiding surface is close to the central axis in a direction from the second abutting portion toward the first abutting portion.

5. The socket storage device of claim 1, wherein the socket holder further includes a connecting portion, the connecting portion is a pivot, the pivot is rotatably disposed within the arcuate slot, the connecting portion has at least one first engaging portion, the arcuate slot has at least one second engaging portion, the at least one first engaging portion is detachably engaged with the at least one second engaging portion, one of the at least one first engaging portion and the at least one second engaging portion is a recess, and the other of the at least one first engaging portion and the at least one second engaging portion is a projection.

6. The socket storage device of claim 5, wherein the connecting portion further has at least one elastic engaging portion which is radially deformable, and the at least one first engaging portion is disposed on the at least one elastic engaging portion.

7. The socket storage device of claim 5, further including a locking rod, wherein the locking rod is connected with the base, the connecting portion has a notch radially disposed thereon, the locking rod is disposed within the notch, the base and the socket holder respectively have a first restricting portion and a second restricting portion which are disposed at two opposite sides of the locking rod and abutted against the locking rod.

8. The socket storage device of claim 1, wherein the engagement portion is formed in a hooked shape, the engagement portion has an engaging slot, the blocking portion has a concave portion and an apex corner, the engagement portion and the blocking portion are engaged with each other, the apex corner is disposed within the engaging slot, and a free end of the engagement portion is disposed within the concave portion.

9. The socket storage device of claim 1, wherein the engagement portion is radially swingable relative to the main portion, the engagement portion has a head section and a neck section, the neck section is bent toward a radial direction of the insertion portion, the locking portion is axially movable and abutted against the head section, the head section has a protruding structure protruding radially from the neck section, and the protruding structure is configured to be abuttable against the socket.

10. A socket storage device, including:

a base, having an assembling portion;

a socket holder, disposed on the assembling portion and being rotatable between a first position and a second position, including an insertion portion and a locking portion, the insertion portion configured to be detachably connected with a socket, the insertion portion including a main portion and an engagement portion which is movable relative to the main portion, the locking portion including a blocking portion which is movable between a third position and a fourth position:

wherein when the socket holder is in the first position, the blocking portion is in the third position, the locking portion is biased against the engagement portion, and the engagement portion is unmovable relative to the main portion and configured to be abutted tightly against the socket when the socket holder is in the second position, the blocking portion is in the fourth position, and the engagement portion is movable relative to the main portion and the socket is detachable from the insertion portion;

wherein the assembling portion includes an arcuate slot, the base further has a first blocking surface and a second blocking surface which are disposed at two opposite sides of the arcuate slot, the second blocking surface is lateral to the first blocking surface, and the insertion portion has a first abutting surface which is abuttable against the first blocking surface and a second abutting surface which is abuttable against the second blocking surface.

11. The socket storage device of claim 4, wherein the base defines a vertical direction extending vertically from a bottom of the base toward a top of the base, the socket holder further includes a connecting portion connected with the assembling portion, the connecting portion and the insertion portion are arranged on a first direction, the first direction is parallel to the vertical direction when the socket holder is in the first position, and the first direction is lateral to the vertical direction when the socket holder is in the second position; the second abutting portion is a groove; the connecting portion is a pivot, the pivot is rotatably disposed within the arcuate slot, the connecting portion has a plurality of first engaging portions, the arcuate slot has a plurality of second engaging portions, one of the plurality of first engaging portions is detachably engaged with one of the plurality of second engaging portions, one of at least one of the plurality of first engaging portions and at least one of the plurality of the second engaging portions is a recess, and the other of at least one of the plurality of first engaging portions and at least one of the plurality of the second engaging portions is a projection; the connecting portion has at least one elastic engaging portion which is radially deformable, the plurality of first engaging portions are disposed on the at least one elastic engaging portion; the engagement portion is formed in a hooked shape, the engagement portion has an engaging slot, the blocking portion has a concave portion and an apex corner, the engagement portion and the blocking portion are engaged with each other, the apex corner is disposed within the engaging slot, and a free end of the engagement portion is disposed within the concave portion; the engaging slot has an inclined abutting surface, the inclined abutting surface is inclined away from the leg portion in a direction remote from the engagement portion, and the free end of the engagement portion is abutted against the inclined abutting surface; the engagement portion is radially swingable relative to the main portion, the engagement portion has a head section and a neck section, the neck section bent toward a radial direction of the insertion portion, the locking portion is axially movable and abutted against the head section, the head section has a protruding structure protruding radially from the neck section, and the protruding structure is configured to be abuttable against the socket; the first abutting portion is an arcuate surface which is close to the central axis in a direction toward the second abutting portion.

* * * * *